US005966823A

United States Patent [19]

Kerkinni

[11] Patent Number: 5,966,823

[45] Date of Patent: Oct. 19, 1999

[54] MEASURING DEVICE FOR TAILORING

[75] Inventor: Fuat John Kerkinni, Minneapolis, Minn.

[73] Assignee: Faut John Kerkinni, Minneapolis, Minn.

[21] Appl. No.: 08/731,197

[22] Filed: Oct. 7, 1996

[51] Int. Cl.[6] ..... A41H 1/06

[52] U.S. Cl. ..... 33/2 R; 33/17 R; 33/42; 33/484

[58] Field of Search ..... 33/2 R, 17 R, 33/2 H, 484, 485, 486, 489, 511, 512, 514.1, 42

[56] References Cited

U.S. PATENT DOCUMENTS

| | | | |
|---|---|---|---|
| 1,035,818 | 8/1912 | Caldwell | 33/485 |
| 1,394,992 | 10/1921 | Fry | 33/42 |
| 1,448,827 | 3/1923 | Burnett | 33/42 |
| 2,112,930 | 4/1938 | Shulman et al. | 33/2 R |
| 2,404,638 | 7/1946 | Keet | 33/2 R |
| 2,813,340 | 11/1957 | Gemignani | 33/2 R |
| 2,840,912 | 7/1958 | Montana | 33/2 R |
| 3,197,875 | 8/1965 | D'Azzo | 33/2 R |
| 3,345,748 | 10/1967 | Snyder | 33/2 R |

*Primary Examiner*—Christopher W. Fulton
*Attorney, Agent, or Firm*—Friederichs Law Firm, plc.

[57] ABSTRACT

A cuff measuring device for tailors, including a thumb cap, an elongated portion and a slide, the thumb cap sized to receive the tip of a person's thumb, the elongated portion including indicia for measuring and being joined to the thumb cap and the slide providing a cuff rest and a chalk carriage, the slide being slidably mounted to the elongated portion to adjust the cuff rest against a garment cuff, the chalk carriage, including chalk providing a sliding mechanism for marking the garment for folding or cutting.

16 Claims, 1 Drawing Sheet

MEASURING DEVICE FOR TAILORING

The present invention relates to tailoring and more particularly to devices used to measure sleeve length on men's and women's suits.

BACKGROUND OF THE INVENTION

The making of clothes has been taking place for many centuries. Initially, each person or family made their own clothes. Eventually, specialists started to develop that made clothes for others. No doubt this developed because certain persons exhibited superior skills in making clothes and their services became in high demand. Today there is the well recognized profession of Tailoring. As this skill developed, so did the styling of clothes. Today men's and women's suits are a staple item of clothing, considered essential in the business and social world. Suits are available as an off-the-shelf item that can be purchased in a variety of sizes, styles, and fabrics.

While suits are available in standard sizes, the suits generally need to be altered to fit the individual. Sleeve lengths need to be adjusted. Measuring sleeves is an almost impossible task. The tailor measures and adjusts the sleeves in a multi-step process using a ruler. First, the tailor folds one sleeve upwardly, creating a temporary sleeve cuff. The cuff may be held in place using common straight pins. Next the tailor places one end of a ruler at the thumb knuckle and measures the distance to the lower edge of the temporary sleeve cuff. The ruler is then moved to the other arm and the sleeve is marked, for example, with tailor's chalk at the point that corresponds to the lower edge of the sleeve of the first arm. Once the mark is in place the ruler is removed and the tailor proceeds to cut and sew the cuff of the two sleeves in the appropriate length.

Certain portions of this process are difficult. In doing the measurements, the tailor needs to use one hand to hold one end of the ruler against the customer's thumb, use one hand to hold the ruler against the sleeve cuff, and use another hand to handle the chalk. Obviously, the task would be much simpler using three hands. The present invention overcomes the problem of not enough available hands.

IN THE DRAWINGS

SUMMARY OF THE INVENTION

The present invention is a measuring and marking device for tailors. The invention includes as primary components a thumb cap, an elongated portion and a slide. The thumb cap has a wall circumscribing an upper thumb receiving opening and a lower end. The cap is sized to snugly receive a tip of a thumb. The lower end may be partially closed with a bottom wall and may have defined therein an opening. The elongated portion may include indicia commonly found on a ruler, e.g. inches or millimeters.

The elongated portion is preferably at least six inches long and may for example be about one half inches in width. The slide is slidably joined to the elongated portion. The slide may include a cuff rest and a chalk carriage. The chalk carriage preferably includes tailor's chalk mounted in the chalk carriage for marking the garment.

DETAILED DESCRIPTION

Figure 1:
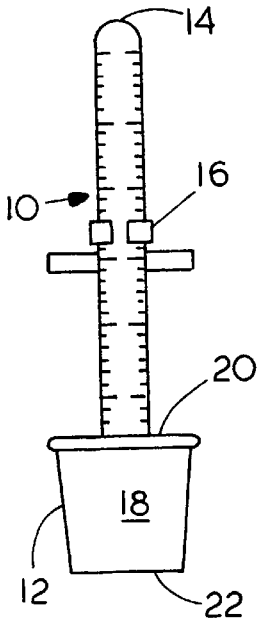
FIG. 1 is a front view of a preferred embodiment of the present invention.
Figure 2:
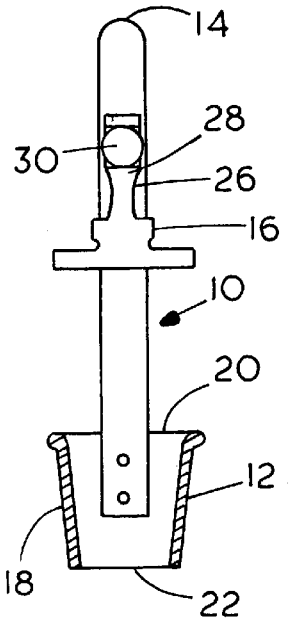
FIG. 2 is a rear view of a preferred embodiment of the present invention.
Figure 3:
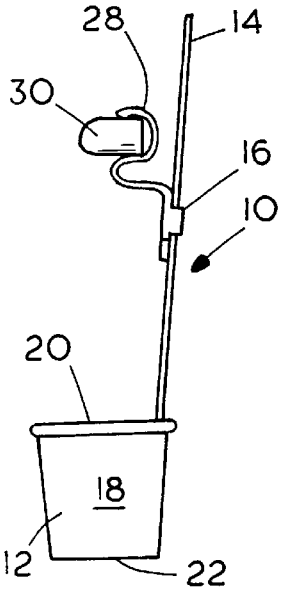
FIG. 3 is a side view of a preferred embodiment of the present invention.
Figure 4:
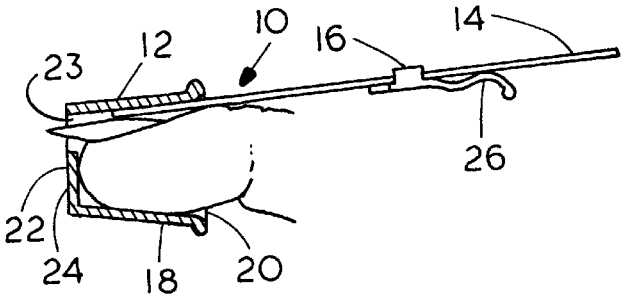
FIG. 4 is a crossectional side view of a preferred embodiment of the present invention.

The device 10 (FIGS. 1–4) is a measuring device for cuffs. A tailer uses the device 10 to assure quality measuring, which is a necessary and integral part of developing a properly fitted garment. The device 10 may include a thumb cap 12, an elongated portion 14 and a slide 16. Each component will be further described in order.

The thumb cap 12 is a generally cylindrical or frustoconical portion, although it may be of any shape that readily receives the tip of a person's thumb. The thumb cap 12 may have a wall 18, which may be continuous, defining an upper thumb receiving opening 20 and a lower end 22. The lower end 22 may be partially or fully closed with a bottom wall stop 24. The bottom wall stop 24 may engage the thumb during operation to assure proper vertical alignment of the thumb cap 12 relative to the person's thumb. The bottom wall stop 24 may partially cover the lower end 22 and yet allow a space or opening 23 for the thumb nail to extend through the lower end 22, while the flesh of the thumb rests against the bottom wall stop 24. The thumb cap 12 is preferably sized to snugly, although not tightly, receive the thumb tip of the person seeking tailored clothing when the thumb cap 12 is properly adjusted relative to the thumb.

Various sizes can be manufactured to accommodate various sizes of thumbs. The thumb cap 12 may be made of a variety of materials, including a variety of plastics and metals. Preferably the material is of a relatively rigid material although some flexibility may prove useful for fine adjustment of the device 10 on the thumb.

The ruler portion 14 may be permanently or selectively attached to the thumb cap 12 via any method, such as those commonly known in the art of attachments. The attachment may be via adhesive, mechanical linking, or integral connection. The elongated portion 14 preferably includes indica for identifying lengths such as inches, centimeters or both, including appropriate subdivisions thereof. Such indicia does not need to be present, although it may prove helpful in some circumstances. The elongated portion 14 is preferably of a material that is stiff and resilient. Such material can be a metal or suitable plastic. The material should be stiff enough to remain elongated without user assistance and flexible enough to avoid breaking, warping, or other such use related damage. The elongated portion 14 may be approximately six (6) inches or longer in length and approximately one half (½) inch or wider in width. The length is important to the particular measurements that tailors may make using the device 10.

The slide 16 includes a mechanism for slidable attachment to the elongated portion 14 such as friction fitting or any other method, such as those known in the art of attachments. The slide 16 selectively moves along the elongated portion 14, adjusting to different distances relative to the thumb cap 12. The slide 16 may include a cuff rest 26. The cuff rest 26 and the thumb cap 12 may be on the same side of the elongated portion 14. The slide 16 may also include a chalk carriage 28 for tailor's chalk 30 or other clothing indicator. The chalk carriage 28 may more horizontally relative to the elongated portion 14, allowing the tailor to mark the fabric without removing the chalk indicator 30 from the carriage 28. The chalk 30 may be any suitable material for marking clothing that has been sized and fitted to the carriage 28.

In operation, the tailor places the person's thumb into the thumb cap 12. The slide 16 is adjusted along the elongated portion 14 until the cuff touches the cuff rest 26. The elongated portion 14 may, at this time, be read to determine the distance of the cuff from the thumb tip in the manner that one reads a ruler. The tailor then removes the device 10 and places the person's other thumb into the thumb cap 12 without having moved the slide 16 (or re-adjusting as needed). The tailor then moves the chalk carriage 28 with chalk 30 horizontally relative to the elongated portion 14 to mark the desired location of the cuff on the person's other sleeve. The device 10 and methodology provides greater accuracy and ease in identifying the location of the cuff.

The present invention has been described with preferred features and methods of use. One with ordinary skill in the art may determine the modifications that can be made to the invention without departing from the spirit and scope of the invention.

What I claim is:

1. A measuring device comprising:

a thumb cap, the thumb cap having a wall circumscribing an upper thumb receiving opening and a lower end, the thumb cap being sized to snugly receive a tip of a thumb, the lower end being at least partially closed with a bottom wall and the lower end defining an opening sized to permit a thumbnail to extend therethrough;

an elongated portion joined to the thumb cap, the elongated portion being a ruler and the elongated portion being at least six inches long and at least one half inches wide; and a slide slidably joined to the elongated portion, the slide including a cuff rest and a chalk carriage and the slide including tailor's chalk mounted in the chalk carriage.

2. A measuring device comprising:

a thumb cap, the thumb cap having a wall circumscribing an upper thumb receiving opening and a lower end, the thumb cap being sized to snugly receive a tip of a thumb, the lower end being at least partially closed with a bottom wall;

an elongated portion joined to the thumb cap; and a slide slidably joined to the elongated portion, the slide including a cuff rest and a chalk carriage and the slide including an indicator mounted in the chalk carriage.

3. The device of claim 2 wherein the indicator is chalk.

4. The device of claim 3 wherein the chalk is tailor's chalk.

5. The device of claim 2 wherein the elongated portion is a ruler.

6. The device of claim 2 wherein the elongated portion is at least six inches long and at least one half inches wide.

7. A measuring device comprising:

a thumb cap, the thumb cap having a wall circumscribing an upper thumb receiving opening and a lower end, the lower end is partially closed with a bottom wall;

an elongated portion joined to the thumb cap; and a slide slidably joined to the elongated portion, the slide including a cuff rest and a chalk carriage and the slide including an indicator mounted in the chalk carriage.

8. The device of claim 7 wherein the lower end is sized to permit a thumbnail to extend therethrough.

9. The device of claim 7 wherein the indicator is chalk.

10. The device of claim 9 wherein the chalk is tailor's chalk.

11. The device of claim 7 wherein the elongated portion is a ruler.

12. The device of claim 7 wherein the thumb cap is sized to snugly receive a tip of a thumb.

13. The device of claim 7 wherein the elongated portion is at least six inches long and at least one half inches wide.

14. The device of claim 7 wherein the thumb cap is integral with the elongated portion.

15. The device of claim 7 wherein the thumb cap is flexible.

16. The device of claim 7 wherein the elongated portion is sufficiently stiff to remain elongated without user assistance and sufficiently flexible to avoid damage from use.

* * * * *